United States Patent [19]

Morganson et al.

[11] Patent Number: 4,861,518

[45] Date of Patent: Aug. 29, 1989

[54] NON-FILMING HIGH PERFORMANCE SOLID FLOOR CLEANER

[75] Inventors: Stephen A. Morganson; John L. Beecher, both of Eagan, Minn.

[73] Assignee: Ecolab Inc., St. Paul, Minn.

[21] Appl. No.: 226,609

[22] Filed: Aug. 1, 1988

[51] Int. Cl.[4] ..... C11D 3/26; C11D 17/00

[52] U.S. Cl. ..... 252/548; 252/156; 252/158; 252/170; 252/174; 252/174.21; 252/174.22; 252/90; 252/DIG. 16

[58] Field of Search ..... 252/158, 134, 174.21, 252/DIG. 16, 544, 174, 548, 174.22, 156, 170, 90

[56] References Cited

U.S. PATENT DOCUMENTS

| | | | |
|---|---|---|---|
| 32,763 | 10/1988 | Fernholtz et al. | 252/90 |
| Re. 32,818 | 1/1989 | Fernholz et al. | 252/90 |
| 4,077,896 | 3/1978 | Bunegar et al. | 252/90 |
| 4,569,781 | 2/1986 | Fernholz et al. | 252/92 |
| 4,652,392 | 3/1987 | Baginski et al. | 252/109 |
| 4,690,305 | 9/1987 | Copeland | 222/52 |
| 4,747,880 | 5/1988 | Berrido et al. | 106/207 |

*Primary Examiner*—Prince E. Willis
*Assistant Examiner*—Susan Franklin
*Attorney, Agent, or Firm*—Merchant, Gould, Smith, Edell, Welter & Schmidt

[57] ABSTRACT

A solid cleaning concentrate composition for aqueous dilution to form a non-filming floor cleaner, said concentrate comprising a major portion of a carrier for inertly containing the active ingredients of said concentrate in a solid cast mass prior to dilution, said active ingredients comprising an effective amount of a surfactant component for imparting wettability and lypophilic solubilizing character to said non-filming floor cleaner an effective amount of a solubilizer for solvating fatty oils and grease on the surface of application, and an effective amount of alkali for maintaining said non-filming floor cleaner above a pH of 9.0 upon dilution.

16 Claims, No Drawings

NON-FILMING HIGH PERFORMANCE SOLID FLOOR CLEANER

FIELD OF THE INVENTION

This invention relates to solid floor cleaning concentrate compositions and more specifically, to a concentrate composition which when dispensed and diluted results in a floor cleaner having a non-filming character.

BACKGROUND OF THE INVENTION

The cleaning art has developed a number of various forms of floor cleaner including, for example, liquids, gels, particulates and slurries. In the past, the principle focus has been on liquid floor cleaners.

Liquid floor cleaners, intended for commercial use, can be problematic in manufacture and use. For instance, being dilute, the inherent added volume of diluent in the liquid cleaner results in higher shipping costs due to the added bulk. Also, the added volume of a liquid requires greater storage space both at the location of manufacture and at the location of use. The increased volume and overall size of a liquid cleaner also results in a higher packaging cost. One of the most critical problems faced by the use of a liquid floor cleaner is the hazard of manufacturing, shipping and applying a product which tends to have an elevated caustic character.

To overcome these problems, our research has refocused on concentrated floor cleaning compositions which are manufactured as a cast solid and then diluted and mixed at the point of application. The solid floor cleaner, in turn, eliminates many of the hazards resulting from the manufacture, shipment and use of a caustic liquid floor cleaner. Also, the use of a solid floor cleaner composition, which may be diluted at the point of application, provides many economies of packaging, shipping and storage which are unattainable with a high bulk liquid floor cleaners.

However, one of the problems encountered in the manufacture and use of solid floor cleaning concentrates is the formation of residual films on the surface of application. Certain post-application processes such as vacuum suctioning, rinsing, or the like will eliminate a residual film on the surface of application. However, the application environment is not always conducive to the use of such post-application processes. Furthermore, these processes have to be strictly followed to completely prevent film formation. Finally, the need to use these post-application processes reduces the economy and efficiency of the entire cleaning process.

SUMMARY OF THE INVENTION

We have found a solid floor cleaning concentrate composition having the aforementioned economies as well as safety in manufacture and use which has a surprising nonfilming character. More specifically, the composition of the present invention contains a surfactant system, a solubilizer for solvating fatty dirts and oils, an alkali metal base to maintain the pH of the floor cleaning composition after dilution and, in turn, heighten clean efficacy, and a solid water soluble carrier which assists in converting the mixture to a solid mass and provides the inert containment of the actives.

DETAILED DESCRIPTION OF THE INVENTION

In accordance with the present invention, there is provided a solid cleaning concentrate composition comprising a surfactant system, a solubilizer, an alkalinity source, and a solidifying carrier, diluent or processing aid. The composition of this invention is manufactured in a concentrate formulation through a series of steps which comprise heating the surfactant system and carrier in a mixing vessel, adding the alkali and solubilizer into the vessel, mixing the components to create a homogenous liquid composition, and forming the solid concentrate floor cleaning composition in a capsule. The solid floor cleaning concentrate composition of this invention may in turn, be dispensed through any variety means including a standard dilution, hydraulic dispensing, or the like.

The first component of the solid cleaning concentrate is the surfactant system. The preferred surfactant system functions as a penetrant to add wettability to the composition allowing easy dilution and solubilization of the solid floor cleaning concentrate. The surfactant system also solubilizes fatty soils and lowers surface tension, thus adding surface activity to the composition.

Generally, the surfactant system may be composed of nonionic or anionic surfactants. Preferably, the surfactant system is composed of nonionics as anionics surfactants tend to promote high foaming characteristics which make the manufacturing and application process of a floor cleaner more difficult. In contrast, nonionics provide good solvency and low surface activity with an ability to solubilize a wide variety of contaminants found on commercial floor environments.

Commonly used nonionics are those containing alkoxylate chains. Specifically, onionics having ethoxylate chains ranging in length from about 6 moles to about 10 moles have been found to be of utility. Generally, nonionics such as alcohol ethoxylates being either linear $C_6$-15 alcohols or branched $C_6$-12 alcohols are preferred. Nonyl phenol ethoxylates have also been found to be of particular utility.

Moreover, the surfactant system is preferably a two constituent blend of nonionic surfactants. The first constituent, generally having a concentration around 10% ±2%, is preferably a nonylphenol ethoxylate having about 9 to 10 moles of ethoxylation which imparts a hydrophilic character to the cleaning system as well as the solid floor cleaning concentrate composition. Also, the high degree of ethoxylation adds wettability to the solid floor cleaning concentrate composition of the invention.

Preferably, the other constituent of the surfactant system is a nonylphenol ethoxylate surfactant having a lower degree of ethoxylation—approximately 6 to 7 moles. The lower concentration of ethoxy groups adds nonpolarity to the composition of the invention and thereby imparts a lypophilic characteristic for solubilizing fatty soils.

Specific examples of nonionics useful in the surfactant system of the present invention are Igepal 630 from GAF, Makon 10 from Stepan, and Triton N101 from Rohm & Haas as common sources of the hydrophilic constituent of the present invention. A common example of chemicals which may be used for the lypophilic constituent of the surfactant system is Igepal 530 from GAF.

The concentration of the surfactant system within the entire concentrate composition ranges from about 7% to 16% and is preferably 10% to 14%, given a two constituent surfactant component. The overall concentration range of this component will be split between a hydrophilic constituent comprising about 10%±2% and a lypophilic constituent comprising about 3%±1%.

The solid floor cleaning concentrate composition of the present invention also contains a solubilizer. The solubilizer imparts a degreasing character to the composition by solubilizing fatty soils and dirts.

Generally, the solubilizer is an organic solvent type constituent able to solubilize greasy soils which does not contribute a toxic character to the final concentrate product. Specifically, exemplary chemicals used in the invention are compounds such as monoethanolamine, ethylene glycolmonobutyl ether, also known as Butylcellosolve, or diethyleneglycol monoethyl ether, also known as Carbatol, both available from Union Carbide Corporation.

Generally, the composition of the present invention will contain approximately 5% to 20% and preferably 7% to 9% of solubilizer. The upper concentration of solubilizer is limited by the intended physical properties of the final solid concentrate composition. In other words, the use of too much solubilizer will result in the solid concentrate becoming maleable or soft. In contrast, lowering the concentration of the solubilizer results in a loss of solvency and, in turn, a loss of oily soil removing efficacy for the solid floor cleaning concentrate upon dilution and application.

Another element of the composition of the present invention is an alkalinity source. The alkali source raises the pH of the concentrate composition to greater than 9 with a useful range being 11.0 to 12.5 and a preferred range being 11.5 to 12.0. The higher pH increases the efficacy of the chemical breakdown and facilitates the rapid dispersion of soils. The general character of the alkalinity source is only limited to those chemical compositions which have a greater solubility. That is, the alkalinity source should not assist in promoting the formation of filming salts. Exemplary products which may be used as an alkalinity source are sodium hydroxide, or potassium hydroxide. Also, volatile bases such as amines and, specifically, monoethanol amine may be used as an alkalinity source. These compounds are readily available from sources such as PPG, Stouffer, Dow Chemical, Ashland Chemical, or Union Carbide Corporation.

The alkalinity source may be added to the composition as a liquid or solid. Caustic (NaOH) is commonly available in any variety of forms including solid beads or flakes or in solution. Usually, the alkalinity source is present as NaOH or KOH in a concentration of 2.0 to 4.4% of a 50% (w/v) solution. The alkali concentration should be maintained at a level which facilitates cleaning yet doesn't preclude removal of the floor cleaner from the surface of application after washing.

The final element of the solid floor cleaning composition of the present invention is the carrier. During processing, the carrier converts the composition of the present invention into a cast solid. Moreover, once converted into a solid, the carrier allows inert portable containment of the active ingredients, namely, the cleaning system, the alkalinity source, and the solubilizer within the composition.

Generally, the carrier may be any water soluble organic filler which creates a solid matrix. Preferably, the organic filler used has a low concentration of inorganics, thus avoiding the formation of salts or residual films on the surface of application.

A specific exemplary chemical which may be used is polyethylene glycol having a molecular weight of approximately 3000 to 8000 commonly available from Union Carbide Corporation.

Generally, the quantity of carrier is 15% to 50% and preferably 28% to 36%. The concentration of carrier should be adequate to form a solid cast product while still providing a material which is water soluble and can readily be dispensed into an aqueous system.

TABLE I

| Composition Component Concentration Ranges | | | |
|---|---|---|---|
| CONSTITUENT | WORKING RANGE | USEFUL RANGE | PREFERRED RANGE |
| Surfactant | 7–16% | 9%–15% | 10–14% |
| Solublizer | 5–20% | 5%–15% | 7–9% |
| Alkali | pH >9 | pH 11–12.5 | pH 11.5–12.0 |
| Carrier | 15–50% | 25%–40% | 28–36% |

In accordance with another aspect of the invention there is provided a process for formulating the composition of the invention comprising the steps of heating the elements of the composition, mixing the heated elements, and forming the mixture into a solid usable concentrate mass.

The first step of the process is heating the chosen surfactant and carrier components. The heating step melts the carrier component in the surfactant system to provide a homogenous mixture. This step also provides a liquid mixing environment for the solubilization and intermixing of the entire concentrate composition prior to solidification.

Specifically, the carrier is added to the surfactant system and the temperature of the mixture is raised to approximately 130° F. to 150° F. The preferred temperature will be above the melting point of the carrier but not so high as to char the mixture.

The next step is the mixing of all the elements into the surfactant system/carrier mix. The mixing step provides for greater homogenization of the composition of the invention. Specifically, alkali is added to the surfactant - carrier molten mixture while at a temperature of 130° to 150° F. Next, the appropriate amount of solubilizer is added to the molten mixture. The effect of adding the solubilizer is to cool the composition and thus, lessen the exposure time to the fumes of the molten mixture.

The final step in the process is forming the solid floor cleaning concentrate into a cast solid. The formation step is completed in a manner and at a rate which maintains the homogeneity of the mixture and allows for economical production of the composition.

Specifically, once completely mixed, the composition is poured at a temperature of approximately 115° to 130° F. into any of a variety of capsule containers. The preferred pouring temperature will allow for the efficient decanting of the molten mixture, yet, not be so great as to result in a phase separation of the mixture or create the need for extended cooling time.

The composition may be formed into any weight or volume of solid composition. It has been found that the 1 to 10 pound capsules are commercially advantageous as they strike a balance between providing a readily portable volume and an economically optimal quantity of the floor cleaning concentrate.

The forming step is completed by cooling the concentrate composition. Preferably, the mixture is cooled in either a chilling or a water cooling tunnel having a temperature ranging generally from below 32° F. to 70°

F. Preferably, the temperature of the cooling tunnel will maintain an efficient and economical manufacturing process requiring a cooling time not exceeding 2 hours.

Once the solid floor cleaning concentrate of the invention is formed within the capsules, it may be shipped and dispensed in any variety of manners. Common methods of dispensing the floor cleaner of the present invention include simple dilution, hydraulic dispensing, or the like.

A preferred method of dispensing the solid floor cleaning concentrate composition of the present invention is disclosed in U.S. Pat. No. 4,569,780 to Fernholz et al. Specifically, the solid cast floor cleaning concentrate is surrounded on all sides but its upper surface by a capsule. The cast solid is then placed in a mechanism having a dispensing device designed to dispense liquid aqueous detergent from a solid cast detergent using an impinging liquid spray. The liquid aqueous detergent flows out of the dispensing device generally simultaneously with its formation in the dispenser. After dilution, the floor cleaner has a concentration ranging from about 0.10% to 0.40% and preferably 0.15% to 0.30%.

This controlled dilution of the solid floor cleaning concentrate provides for a more accurate solubilization of the solid concentrate. Thus, the dispenser prevents over-application of floor cleaner resulting from the mixing of too concentrated a solution and, in turn, provides a more economical use of the floor cleaning concentrate.

Upon application, the solid floor cleaning concentrate composition of this invention has a non-filming character. The working examples, provided below, exhibit the characteristics of the non-filming solid floor cleaning concentration of this invention upon application.

EXAMPLES

Comparative Examples A–C and working Examples 1 and 2 were prepared to exhibit the non-filming character of the working examples. All examples were prepared in accordance with the process of the present invention as detailed in the preceding paragraphs.

Specifically, five 10% solutions each containing 50 grams of solids were prepared having constituent concentrations as shown in Tables II and III. The first step in preparing the concentrate composition was to charge a 600 milliliter beaker containing water with the appropriate amount of nonyl phenol ethoxylate having 9.5 moles of ethoxylation and nonyl phenol ethoxylate having 6.5 moles of ethoxylation. The beaker was then placed on a hot plate and stirred. The appropriate amount of polyethylene glycol 8000 was then added to the beaker and the components were heated to 130° Fahrenheit. During the heating process, the system was continually stirred. The elapsed time from room temperature until the mixture reaches 130° was approximately 10 minutes. The mixture was heated until the polyethylene glycol was melted.

Once the PEG melted, the dye and solubilizer were added to the mixture. In this specific instance, both ethylene glycol monobutyl ether and monoethanolamine were used as a solubilizer. The composition is then mixed until it was homogeneous. At this point, the working examples were completed.

However, in order to form the comparative examples, additional elements were added to the three remaining mixing flasks. To form comparative Example A, Cabosil or silicon dioxide was added at a temperature of 120° to 125° Fahrenheit and mixed for 20 minutes. The silicon dioxide thickens the composition. Once the viscosity of the mixture has increased, sodium tripolyphosphate and/or sodium metasilicate were added to the compositions during mixing. Once an adequate dispersion of the sodium metasilicate and sodium tripolyphosphate was completed, these mixtures were then completed.

The resulting formulations are shown in Table II as comparative examples and Table II as working examples.

TABLE II

| Constituents | Comparative Examples Ex. A | Ex. B | Ex. C |
|---|---|---|---|
| Nonyl Phenol Ethoxylate 9.5 | 5.15% | 5.15% | 5.15% |
| Nonyl Phenol Ethoxylate 6.5 | 1.35% | 1.35% | 1.35% |
| Polyethylene Glycol (PEG 8000) | 15.5% | 15.5% | 15.5% |
| Dye | .025% | .025% | .025% |
| Ethylene Glycol Monobutyl Ether | 3.5% | 3.5% | 3.5% |
| Monoethanolamine | 13.5% | 13.5% | 13.5% |
| $SiO_2$ | .975% | — | .975% |
| Sodium Metasilicate ($.5H_2O$) | — | 5.0% | 5.0% |
| Sodium Tripolyphosphate | 5.0% | 5.0% | — |
| FILMING | 2 | 2 | 3 |

TABLE III

| Constituents | Working Examples Ex. 1 | Ex. 2 |
|---|---|---|
| Nonyl Phenol Ethoxylate 9.5 | 5.15% | 5.15% |
| Nonyl Phenol Ethoxylate 6.5 | 1.35% | 1.35% |
| Polyethylene Glycol (PEG 8000) | 15.5% | 15.5% |
| Dye | .025% | .025% |
| Ethylene Glycol Monobutyl Ether | 3.5% | 3.5% |
| Monoethanolamine | 13.5% | 13.5% |
| $SiO_2$ | — | — |
| Sodium Metasilicate $.5H_2O$ | — | — |
| Sodium Tripolyphosphate | — | — |
| FILMING | 1 | 1 |

Comparative Examples A, B, and C along with Working Examples 1 and 2 were uniformally applied to identical floor surfaces. All of the examples were then rated on the basis of their tendency to form a deposit or residual film upon the surface of application according to the following scheme.

TABLE IV

| Numerical Rating | Description | Comments |
|---|---|---|
| 1 | No Film | Rating indicates that application of cleaner failed to form residual film on surface of application |
| 2 | Moderate Film | Rating indicates that a thin chalk-like haze was left on the surface of application |
| 3 | Severe Film | Rating indicates that a heavy chalk-like powdery |

TABLE IV-continued

| Numerical Rating | Film Rating Description | Comments |
|---|---|---|
| | | residue was left on surface of application |

Upon uniform application of equal concentrations of Comparative Examples A, B, and C as well as Working Examples 1 and 2 it was found that Comparative Examples B and C resulted in the formation of severe films. Example A resulted in the formation of a moderate film. All three comparative Examples A, B and C, resulted in at least a chalk-like formed a heavy chalk-like powdery residue.

In contrast, Working Examples 1 and 2 failed to form a film when applied at a concentration and in a method which conformed to the same method used to apply the comparative examples.

We claim:

1. A solid cleaning concentrate composition for aqueous dilution to form a non-filming floor cleaner, said concentrate comprising:

a major portion of a water soluble organic carrier for inertly containing the active ingredients of said concentrate in a solid cast mass prior to dilution, said active ingredients comprising:

(i) an effective amount of a nonionic surfactant component for imparting wettability and lypophilic solubilizing character to said nonfilming floor cleaner, (ii) an effective amount of an organic solubilizer for solvating fatty oils and grease on the surface of application, and (iii) an effective amount of an alkalinity source for maintaining said non-filming floor cleaner above a pH of 9.0 upon dilution and selected from the group consisting of alkali metal salts of hydroxide and monoethanolamine, wherein said concentrate composition is diluted to form an aqueous floor cleaner which imparts a non-filming character upon application.

2. The solid cleaning concentrate of claim 1 wherein said carrier is polyethylene glycol having a molecular weight of about 3000 to about 8000.

3. The solid cleaning concentrate of claim 1 wherein said surfactant component is a nonionic surfactant selected from the group consisting of alcohol ethoxylates, nonyl phenol ethoxylates, and mixtures thereof.

4. The solid cleaning concentrate of claim 1 wherein said solubilizer is selected from the group consisting of monoethanolamine, ethylene glycol butylether, diethylene glycol monoethylether, and mixtures thereof.

5. The solid cleaning concentrate of claim 1, wherein said alkalinity source is selected from the group consisting of NaOH, KOH and monoethanolamine.

6. The solid floor cleaning concentrate composition of claim 1, wherein said surfactant component is present in a concentration of from about 7% to about 16%.

7. The solid cleaning concentrate composition of claim 1 wherein, said alkali is present in an amount effective to maintain the pH of the composition between 11.0 and 12.5 upon dilution.

8. The solid cleaning concentrate composition of claim 1, wherein said solubilizer is present in an amount ranging from about 5% to about 20%.

9. A non-filming floor cleaner comprising a major portion of aqueous diluent and from about 0.10% to about 0.40% solid cleaning concentrate composition, said solid cleaning concentrate composition comprising a major portion of a water soluble organic carrier for inertly containing the active ingredients of said concentrate as a solid cast mass prior to dilution, said active ingredients comprising:

(a) an effective amount of a nonionic surfactant component for imparting wettability and lypophilic solubilizing character to said non-filming floor cleaner;

(b) an effective amount of an organic solubilizer for solvating fatty oils and grease on the surface of application, and (c) an effective amount of an alkalinity source for maintaining said non-filming floor cleaner between a pH of 10.5 and 12.5 upon dilution and selected from the group consisting of alkali metal salts of hydroxide and monoethanolamine.

10. A solid cleaning concentrate composition for aqueous dilution to form a non-filming floor cleaner, said concentrate comprising from about 28% to about 36% of a water soluble organic carrier for inertly containing the active ingredients of said concentrate in a solid cast mass prior to dilution, said active ingredients comprising:

(a) from about 10% to about 14% of a nonionic surfactant system for imparting wettability and lypophilic solubilizing character to said non-filming floor cleaner;

(b) from about 7% to about 9% of an organic solubilizer for solvating fatty oils and grease on the surface of application; and (c) an effective amount of an alkalinity source for maintaining said non-filming floor cleaner between a pH of 11.5 and 12.0 upon dilution and selected from the group consisting of alkali metal salts of hydroxide and monoethanolamine, wherein said concentrate composition is diluted to form an aqueous floor cleaner which imparts a non-filming character upon application.

11. The solid cleaning concentrate of claim 10, wherein said alkalinity source is selected from the group consisting of KOH, NaOH and monoethanolamine.

12. The solid cleaning concentrate of claim 10, wherein said surfactant system is selected from the group consisting of alcohol ethoxylates, nonyl phenol ethoxylates, and mixtures thereof.

13. The solid cleaning concentrate of claim 10, wherein said carrier comprises polyethylene glycol having a molecular weight of about 3000 to 8000.

14. The solid cleaning concentrate of claim 10, wherein said solubilizer is selected from the group consisting of monoethanolamine, ethylene glycol butyl ether, diethylene glycol monoethylether, and mixtures thereof.

15. A solid cleaning concentrate composition for aqueous dilution to form a non-filming floor cleaner, said concentrate comprising from about 25% to about 40% of a water soluble organic carrier for inertly containing the active ingredients of said concentrate in a solid cast mass prior to dilution, said active ingredients comprising:

(a) an effective amount of a nonionic surfactant system wherein said surfactant system comprises a first surfactant component having from about 9 to 10 moles of ethoxylation and a second surfactant component having from about 6 to 7 moles of ethoxylation;

(b) an effective amount of an organic solubilizer for solvating fatty oils and grease on the surface of application; and (c) an effective amount of an alkalinity source for maintaining said non-filming floor cleaner between a pH of about 11 and about 12.5 upon dilution and selected from the group consisting of alkali metal salts of hydroxide and monoethanolamine, wherein said concentrate composition is diluted to form an aqueous floor cleaner which imparts a non-filming character upon application.

16. A method for using a solid cleaning concentrate composition for aqueous dilution to form a non-filming floor cleaner, said concentrate comprising a major portion of a water soluble organic carrier for inertly containing the active ingredients of said concentrate in a solid cast capsulized mass prior to dilution, said active ingredients comprising an effective amount of nonionic surfactant component for imparting wettability and lypophilic solubilizing character to said non-filming floor cleaner an effective amount of an organic solubilizer for solvating fatty oils and grease on the surface of application, and an effective amount of an alkalinity source for maintaining said non-filming floor cleaner above a pH of about 9.0 upon dilution and selected from the group consisting of alkali metal salts of hydroxide and monoethanolamine, comprising the steps of:

(a) injecting an aqueous spray into said capsule containing said solid concentrate cleaning composition;

(b) diluting said concentrate composition to provide a floor cleaning composition wherein a major portion of said floor cleaning composition is aqueous diluent and from about 0.10% to 0.40% of said floor cleaning concentrate; and (c) applying said floor cleaner to the intended surface of application, wherein said floor cleaner imparts a non-filming character upon application.

* * * * *

UNITED STATES PATENT AND TRADEMARK OFFICE

CERTIFICATE OF CORRECTION

PATENT NO. : 4,861,518

DATED : August 29, 1989

INVENTOR(S) : Stephen A. Morganson and John L. Beecher

It is certified that error appears in the above-identified patent and that said Letters Patent is hereby corrected as shown below:

In Column 2, line 31, read "onionics" should read --nonionics--.

In Column 7, line 15, read "like formed" should read --like haze on the surface of application and in two instances formed--.

Signed and Sealed this

Thirteenth Day of November, 1990

*Attest:*

HARRY F. MANBECK, JR.

*Attesting Officer*

*Commissioner of Patents and Trademarks*